US005644799A

United States Patent [19]

Armenta et al.

[11] Patent Number: 5,644,799

[45] Date of Patent: Jul. 8, 1997

[54] HEADGEAR ACCESSORY

[76] Inventors: Vincent Armenta, 1824 Lynne Dr.; Louis J. Cruz, 909 Gunnar; Henry S. Alvarez, 515 N. Scott, all of Santa Maria, Calif. 93454

[21] Appl. No.: 414,310

[22] Filed: Mar. 31, 1995

[51] Int. Cl.[6] ..... A42B 1/04

[52] U.S. Cl. ..... 2/209.13; 2/171.5; 2/209.3; 2/209.5; 2/209.7; 24/30.5 S; 132/273

[58] Field of Search ..... 2/171.4, 171.5, 2/184.5, 209.13, 209.3, 209.5, 209.7; 24/30.5 S; 132/273, 276, 278

[56] References Cited

U.S. PATENT DOCUMENTS

| | | | |
|---|---|---|---|
| D. 173,620 | 12/1954 | Krieger et al. . | |
| D. 343,274 | 1/1994 | Paterek . | |
| 2,753,566 | 7/1956 | Perelman | 2/171.5 |
| 2,864,383 | 12/1958 | Jacks et al. . | |
| 3,041,628 | 7/1962 | Fish et al. . | |
| 3,357,070 | 12/1967 | Sloan | 132/273 |
| 4,998,544 | 3/1991 | Obergfell . | |
| 5,156,171 | 10/1992 | Goodman et al. . | |
| 5,170,509 | 12/1992 | Leopold et al. . | |
| 5,301,696 | 4/1994 | Revson . | |
| 5,321,854 | 6/1994 | Kronenberger . | |
| 5,359,733 | 11/1994 | Brannon . | |
| 5,499,638 | 3/1996 | Ripley | 132/273 |

FOREIGN PATENT DOCUMENTS

| | | | |
|---|---|---|---|
| 506725 | 10/1954 | Canada . | |
| 1218932 | 6/1966 | Germany | 24/30.5 S |

*Primary Examiner*—Diana Biefeld

*Attorney, Agent, or Firm*—Richard C. Litman

[57] ABSTRACT

A headgear accessory is adaptable to an existing cap, hat, hood, or other article worn on the head, to cover a hole or passage formed therein to provide for the passage of the hair of the wearer therethrough. Using the present headgear accessory, a hole may be placed in the headgear at a location comfortable for the passage of longer hair (e.g., ponytail, braid, etc.) therethrough, and the accessory sewn or otherwise secured to the headgear to provide a decorative closure for the hole. The accessory is preferably formed of a resilient, flexible material such as neoprene sheet, with a synthetic fabric overlay for additional strength and to provide a more attractive appearance. A series of slots are formed in the neoprene/fabric sheet, through which the wearer's hair is passed. The resilient nature of the sheet material biases the material to each side of each of the slots against the hair, thereby providing greater security for the headgear on the wearer's head and yet providing for ease of removal of the headgear. The periphery and edges of the slots of the accessory may be stitched for greater durability and to provide an attractive appearance, if desired. The accessory may be provided separately, or in combination with various types of hats, caps, hoods, and/or other headgear of virtually any type.

18 Claims, 5 Drawing Sheets

HEADGEAR ACCESSORY

FIELD OF THE INVENTION

The present invention relates generally to hats, caps, hooded garments, and other headgear, and more specifically to an accessory therefor which provides for the securing of the long hair of thee wearer of such headgear through a hole in the upper back of the headgear. The accessory is sewn or otherwise secured over a hole in the headgear, and includes a plurality of radial slots therein which serve to grasp the hair securely to provide security for the headgear, as well as providing an attractive closure for the hole in the headgear.

BACKGROUND OF THE INVENTION

Longer hair which is tied, braided, or otherwise secured in one or more elongate extensions or "tails" to the back of the head, has long been popular among women, and in fact is seen from time to time among men also. Generally, such hair is gathered toward the upper back of the scalp, above the location of the rear portion of the band of a hat or cap, if such is worn.

The result is that the gathering of the hair near the scalp, which by its nature forms a protruding bundle at that point, must be stuffed under the hat or cap, with the remainder of the hair extending outwardly and downwardly below the rear edge or band of the hat or cap. With closely fitting caps (e.g., billed or visored "baseball" style caps, etc.) such a configuration can be somewhat uncomfortable for the wearer of the headgear. Passing the hair through the opening above the usual adjustment band of such caps provides little additional comfort, as it is generally still too low for optimum positioning relative to the gathered hair at the upper back of the scalp. In the case of hats or caps having a specific, non-adjustable size, there is no such rear opening, which further exacerbates the situation.

Moreover, many men and women with longer hair also engage in various vigorous activities (e.g., jogging, etc.). Typically, a cap or hat is worn in colder conditions during such activities, and the hair is captured thereunder. This is especially true when a hooded windbreaker or the like is worn. The result is often that the longer hair absorbs perspiration due to the activity of the person, and becomes damp and uncomfortable as a result. Yet, there is generally no convenient alternative to allow the longer hair to remain free during such activities. While one solution would be simply to cut a hole in the upper back of hats or hoods to be worn, such a hole would be unsightly and would be uncomfortable for use when the hair is not tied back or braided to form a single bundled extension.

Accordingly, a need will be seen for a headgear accessory which provides a neat and attractive passage at the upper back portion of a hat, cap, hood, or other headgear, for the passage of the hair of a longer hairstyle therethrough. The accessory must be easily installable on such headgear, after forming an appropriately sized hole in the headgear, and should be sufficiently flexible to provide substantial closure of the opening when it is not needed. By forming plural slots in the accessory, the flaps of material defined by the slots will be pushed outwardly and will provide at least some resilient gripping of the hair passed therethrough, to provide security both for the hair and for the headgear.

DESCRIPTION OF THE PRIOR ART

U.S. Pat. No. 2,864,383 issued to Elizabeth A. Jacks et al. on Dec. 16, 1958 describes a Holder And Cap Device For A Lady's Pony-Tail Hair-Do comprising a nearly flat, semi-conical outer rim with a semicylindrical central portion extending outwardly therefrom. The assembly is open approximately one quarter of it's circumference in the relaxed condition, and is adapted to be wrapped around a pony tail or other bundled hair fashion by means of a tie. The device provides no automatic closure or gripping of the hair, as provided by the slotted, resilient material of the present accessory, and no means of securing the Jacks et al. device to a hat, cap, or other headgear is disclosed.

U.S. Pat. No. 3,041,628 issued to Alvin K. Fish et al. on Jul. 3, 1962 describes a Novelty Cap formed of a flat sheet of material. A gap is provided at the rear thereof, which forms an opening when the extensions to each side thereof are secured together. However, the opening is a fixed part of the cap, rather than being a part of an accessory therefor, and cannot close or grip the wearer's hair which passes therethrough, as provided by the slotted and resilient nature of the present accessory.

U.S. Pat. No. 4,998,544 issued to Stephen D. Obergfell on Mar. 12, 1991 describes a Combination Headband And Ponytail Holder, comprising a tubular component secured to a headband. The hair is passed through the tubular component and the headband is secured about the head of the wearer. The device cannot be used in combination with any other headgear, as provided by the present accessory, and extends away from the head of the user, unlike the relatively thin, flat, and planar configuration of the present accessory.

U.S. Pat. No. 5,156,171 issued to Joyce E. Goodman on Oct. 20, 1992 describes a Method Of Adorning A Pony Tail And Pony Tail Holder. The holder comprises a generally flat, toroid shaped sheet with an elastic drawstring secured about the inner opening. The draw string must be tightened to secure the device about the hair of the wearer, unlike the present accessory.

U.S. Pat. No. 5,170,509 issued to Lynnabeth Leopold on Dec. 15, 1992 describes a Cap With Decorative Hair Attachment. The attachment is a ruffled band which is separable from the cap, and which may be secured about the hair of the wearer in the manner of other conventional hair bands and the like. The device may include an artificial ponytail or the like, if desired, but is not adaptable to a specialized hair passage opening in the cap or headgear, as provided by the present accessory.

U.S. Patent No. 5,301,696 issued to Rommy H. Revson on Apr. 12, 1994 describes a Decorative Pony Tail Holder And Method Of Using. The holder comprises a ruffled band having an elastic opening therein, through which the hair of the wearer may be passed. The opening cannot provide full closure when it is not needed, nor is the device adaptable to application to an opening in an existing cap or other headgear, as provided by the present invention.

U.S. Pat. No. 5,321,854 issued to Robert A. Kronenberger on Jun. 21, 1994 describes a Headwear Piece With Opening To Accommodate Wearer's Hair. The headwear piece is a relatively tight fitting, visored or billed cap ("baseball" type cap), through which a supplemental hole has been formed in the upper rear thereof. Kronenberger has recognized part of the problem with the location of the hole in the cap as a response thereto, but requires a specialized cap with no closure means for the opening therein, rather than adapting a more attractive and general solution applicable to virtually any headgear, as with the present invention. Moreover, the present accessory provides automatic closure of the opening due to the slotted configuration, as well as some gripping of the hair passing therethrough due to the resilient nature of the material, neither of which advantages are provided by Kronenberger.

U.S. Pat. No. 5,359,733 issued to Garry A. Brannon et al. on Nov. 1, 1994 describes Patch Attachment For Hats, comprising mating hook and loop fastening elements respectively permanently secured to a baseball type billed cap and to display patches removably securable thereto. No holes through either the cap or the display patches are disclosed to provide for passage of the hair of a wearer of the cap, therethrough.

U.S. Pat. No. D-173,620 issued to Rose Krieger et al. on Dec. 7, 1954 describes a design for a Hat including an apparently elastically gathered opening in the crown thereof. The opening cannot be closed and is not adaptable to different headgear, as with the present accessory.

U.S. Pat. No. D-343,274 issued to Concetta M. Paterek on Jan. 18, 1994 describes a design for a Jug Handle Hat. The same points made immediately above concerning the lack of complete closure and adaptability, are also noted here.

Finally, Canadian Patent No. 506,725 issued to Victor T. Hoeflich on Oct. 26, 1954 describes a Paper Hat formed of a flat sheet having a crenelated edge. The sheet is rolled to form a cylinder, and the crenelated edge is drawn closed to form the crown of the hat. A closed patch is placed over the crown. The crown closure provides no opening for hair or other purposes, as provided by the present accessory, is not adaptable to use with other types of headgear due to its integral formation from a specifically configured flat sheet, and moreover cannot be moved to a location other than the center of the crown in any case.

None of the above noted patents, taken either singly or in combination, are seen to disclose the specific arrangement of concepts disclosed by the present invention.

SUMMARY OF THE INVENTION

By the present invention, an improved headgear accessory is disclosed.

Accordingly, one of the objects of the present invention is to provide an improved headgear accessory which is adaptable to an existing cap, hat, hood, or other headgear having a hole therethrough adapted to the passage of the hair of the wearer through the hole.

Another of the objects of the present invention is to provide an improved headgear accessory which is formed of a resilient planar sheet of material and which includes a plurality of evenly spaced slots therein, with the planar sheet biasing the slots closed to form a substantially closed surface when no object is inserted therethrough.

Yet another of the objects of the present invention is to provide an improved headgear accessory which may be formed to have a variety of peripheral geometric shapes and configurations, and any one of a number of different slot configurations therein.

Still another of the objects of the present invention is to provide an improved headgear accessory which may be formed of a relatively thin, resilient material, such as neoprene, or other suitable material, and which may also include a fabric overlay for greater strength and more attractive appearance.

A further object of the present invention is to provide an improved headgear accessory which may include stitching for additional strength and appearance about the periphery thereof, and along the edges of the flaps of material therein, as desired.

An additional object of the present invention is to provide an improved headgear accessory which may be secured either to the inner surface or to the outer surface of the headgear, as desired.

Another object of the present invention is to provide an improved headgear accessory which may be provided in combination with an existing headgear article.

A final object of the present invention is to provide an improved headgear accessory for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
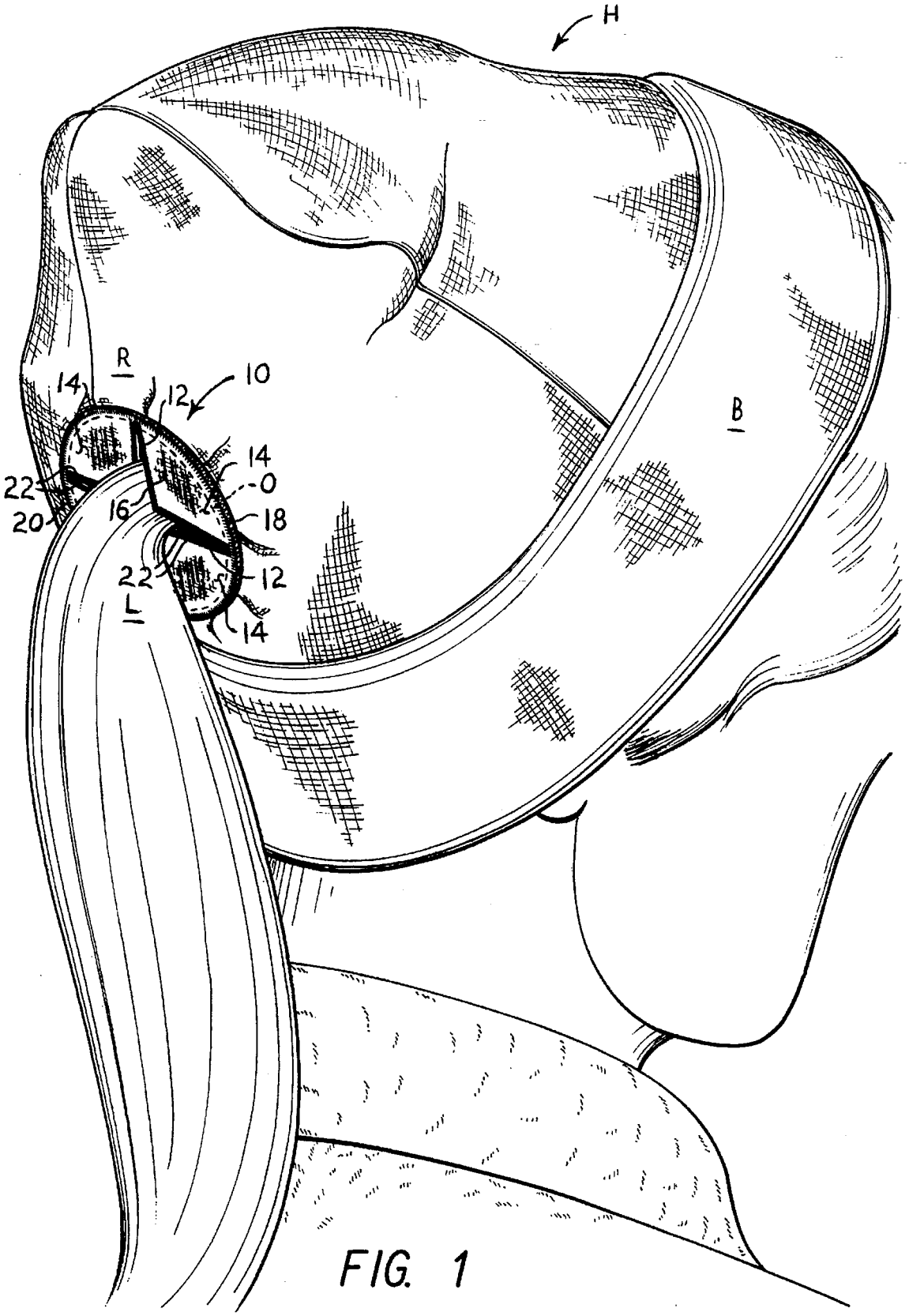
FIG. 1 is a perspective view of a hat or cap showing the present headgear accessory installed thereon, and the features and function thereof.

Referring now particularly to FIG. 1 of the drawings, the present invention will be seen to relate to a headgear accessory 10, which is attachable to an article of headgear such as the hat or cap H of FIG. 1. The upper, rear portion R of such headgear includes a hole or passage O therethrough (shown in broken lines in FIG. 1), adapted to allow the passage of the longer hair L therethrough, so the hat H (a knit stocking or other style cap or hat, which may have a brim B or alternatively, brimless construction, etc.) may be worn comfortably back on the head.

The present headgear accessory 10 is secured across (either outside or inside) the hole O in the headgear, to provide an attractive closure therefor, and further to provide better security for the hair length L (ponytail, braid, etc.) passing therethrough. The accessory 10 may be secured to the hat or cap by means of stitching, iron-on or other adhesives, etc., as desired. The accessory 10 includes a plurality of slots 12 extending thereacross, from a center point radially outward to end near the periphery 20 of the device. (The plan views of various embodiments of the present accessory, as shown in FIGS. 4 through 7, provide a clearer disclosure of the arrangement of the slots.) The slots divide the accessory into a plurality of flaps or segments 14, which segments 14 spread and distend as the length of hair L is passed through the hole O in the hat or cap H, and further through the slots 12 of the headgear accessory 10 secured thereto.

The present headgear accessory 10 is formed of a flat, planar, flexible, and preferably resilient sheet of material, in order to provide the required flexibility of the flaps or segments 14 to conform to the hair length L which is passed therebetween when the headgear H is placed upon the wearer's head. A neoprene sheet material has been found to work very well for the purpose, although other materials may be substituted therefor if desired. The neoprene provides the required flexibility, and further is resilient to urge the closure of the segments 14 about the hair length L passing therebetween, to provide some grasping of the hair length L for greater security of the headgear H on the wearer's head. Yet, the flexible nature of the material allows the accessory 10, and any headgear H to which it is secured, to be donned and removed readily without undue difficulty.

For greater durability, as well as to provide a more attractive appearance, the neoprene sheet may be overlaid with a fabric (preferably synthetic) material 16 (e.g., nylon, tm) as indicated by the woven pattern on the surface of the accessories disclosed in the various drawing figures. This fabric overlay 16 increases the strength of the composite sheet assembly, and may be provided in matching or contrasting colors to the headgear to which the accessory is secured, as desired. Further structural strength for the accessory 10 may be provided by stitching 18 around the periphery 20 thereof, and additional stitching 22 along the edges of the flaps or segments 14, as desired. A "buttonhole" type stitch has been found to work well for securing the edges of the flaps or segments 14, and a similar stitch, or alternatively a more decorative embroidery or other design, may be used for the peripheral stitching 18. As in the case of the fabric overlay, the stitching 18 and/or 22 may be provided in either matching or contrasting colors to the headgear and/or the fabric overlay material of the accessory 10, as desired.

Figure 2:
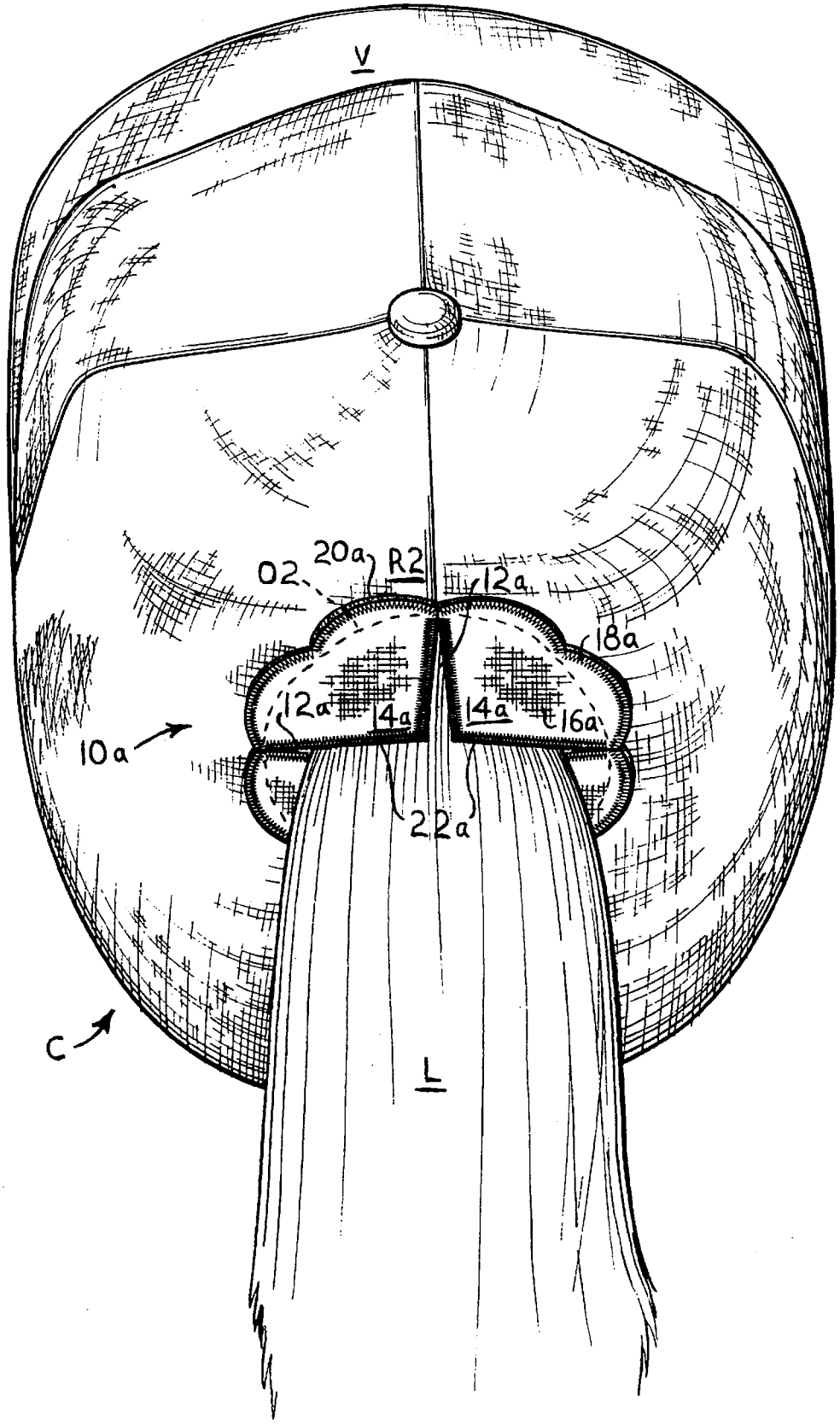
FIG. 2 is a top and rear perspective view of the present headgear accessory having an alternative peripheral shape, and installed on a closely fitting visored, baseball style cap.

FIG. 2 discloses an upper rear perspective view of a closely fitting cap C having a bill or visor V, and having an embodiment 10*a* of the present headgear accessory installed therein. As in the case of the hat H of FIG. 1, the baseball style cap C of FIG. 2 also includes a hole or opening 02 in the upper rear portion R2 thereof. (It will be seen that the various embodiments of the present accessory are adaptable to virtually any type of hat or cap, including caps C as in FIG. 2 which have rearwardly disposed adjustment bands, not shown, or are of a specific size.)

Figure 5:
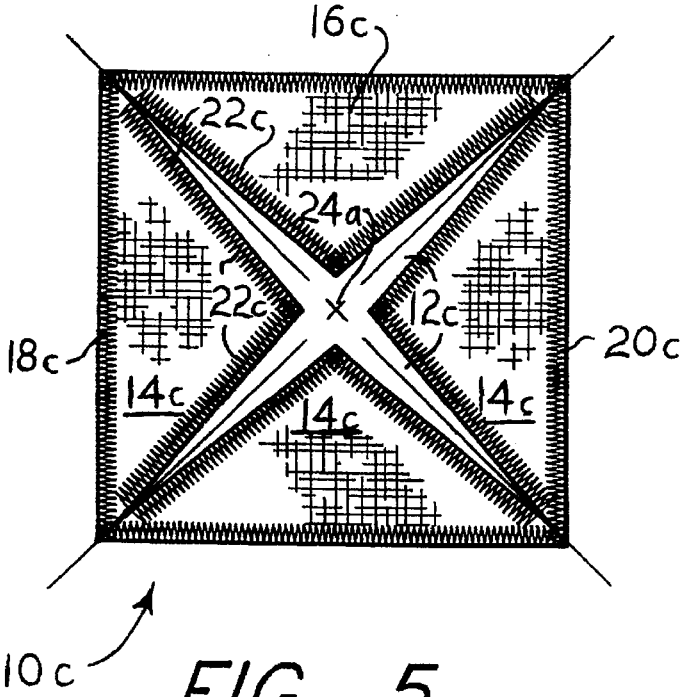
FIG. 5 is a plan view of an alternative configuration of the present headgear accessory.

While the headgear accessory 10 of FIG. 1 incorporates a circular periphery 20, the periphery 20*a* of FIG. 2 will be seen to be formed of a plurality of relatively short and regular convex curves, in a "rosette" pattern R2. A plan view of this embodiment is shown in its entirety and in detail in FIG. 4 of the drawings. The function and structure of the accessory 10*a* of FIGS. 2 and 5 are identical to those of the accessory 10 of FIG. 1, with accessory 10*a* having a plurality of radially disposed slots 12*a* extending from the center 24 thereof (shown in FIG. 4), which slots 12*a* define an equal number of segments 14*a*. The base material may include a fabric overlay 16*a*, and peripheral and segment edge stitching or embroidery 18*a* and 22*a*. The hair length L passes through the hole or opening O2 in the cap C, and further through the opened slots 12*a* between the deflected and distended flaps or segments 14*a*, as described in the embodiment of FIG. 1. It will be understood that any of the embodiments of the headgear accessories of the present invention are adaptable to virtually any type of headgear, and are not limited to specific headgear and accessory combinations as shown in the drawing figures.

Figure 3:
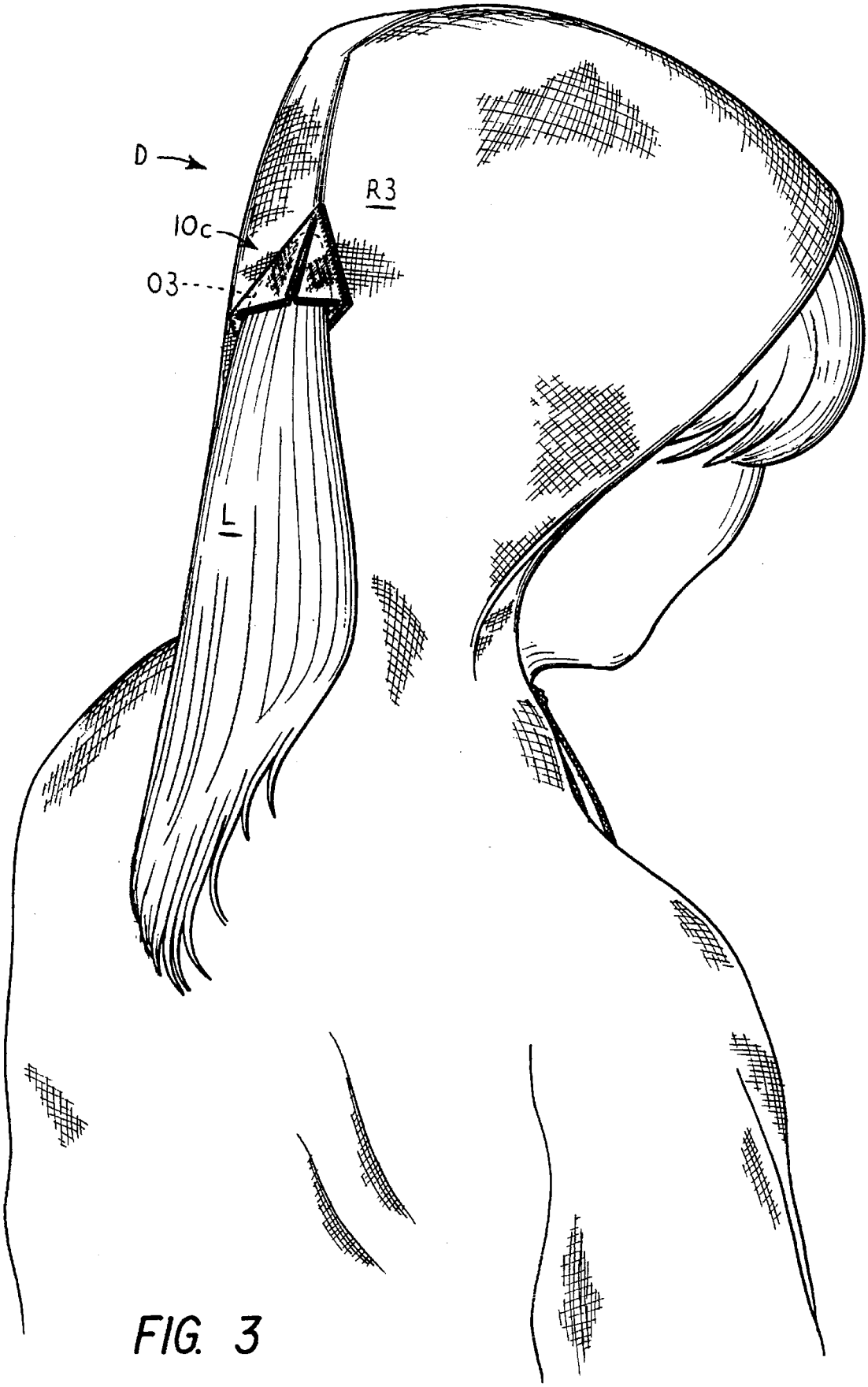
FIG. 3 is a right side and rear perspective view of another embodiment of the present headgear accessory having another peripheral configuration, and installed in the back of a hooded garment.
Figure 4:
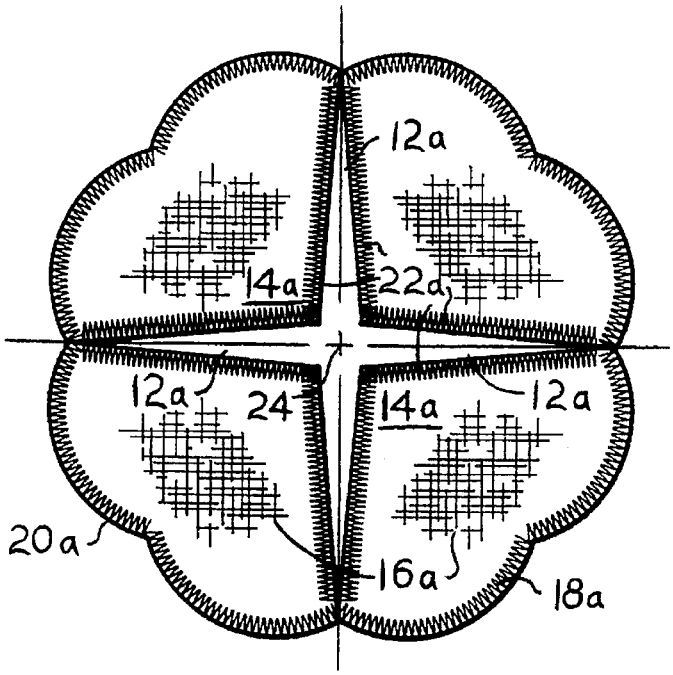
FIG. 4 is a plan view of the headgear accessory of FIG. 2, more clearly showing its features in greater detail.

FIG. 3 discloses yet another adaptation of the present invention, wherein a headgear accessory 10*c* is provided in the upper rear portion R3 of the hood D of a hooded garment (e.g., windbreaker, jacket, etc.). The accessory 10*c* is again secured over (or alternatively, immediately within) a hole or opening O3 formed in the upper rear of R3 of the hood D of the garment, as in the openings O and O2 shown in the hats and caps H and C of FIGS. 1 and 2 respectively; the principle is the same in each case.

The specific configuration of the headgear accessory 10*c* of FIG. 3 is more clearly shown in its entirety in the plan view of FIG. 5, so the reference characters denoting the details of the embodiment of FIGS. 3 and 5 are noted only in FIG. 5, in order to provide clarity in FIG. 3 of the drawings. The accessory 10*c* of FIGS. 3 and 5 will be seen to have a square or rectangular periphery 20*c*, with the sheet of material divided by foul slots 12*c* radiating from a central point 24*a*. While the slots 12*c* are shown diagonally disposed, it will be understood that an orthogonal slot arrangement is also possible. The diagonal arrangement provides longer slots than an orthogonal arrangement, if such longer slots are desired. The slots 12*c* separate a corresponding number of flaps or segments 14*c*. A fabric overlay 16*c* may be provided over the underlying base material sheet, with peripheral and segment edge stitching or embroidery 18*c* and 22*c*, respectively, being provided, as desired. It will be noted that the headgear accessory embodiment 10*c* of FIGS. 3 and 5 is identical in both figures, but that it is shown installed diagonally on the upper rear portion R3 of the hood D in FIG. 3. The configuration is the same in both Figures, however, as noted.

Figure 6:
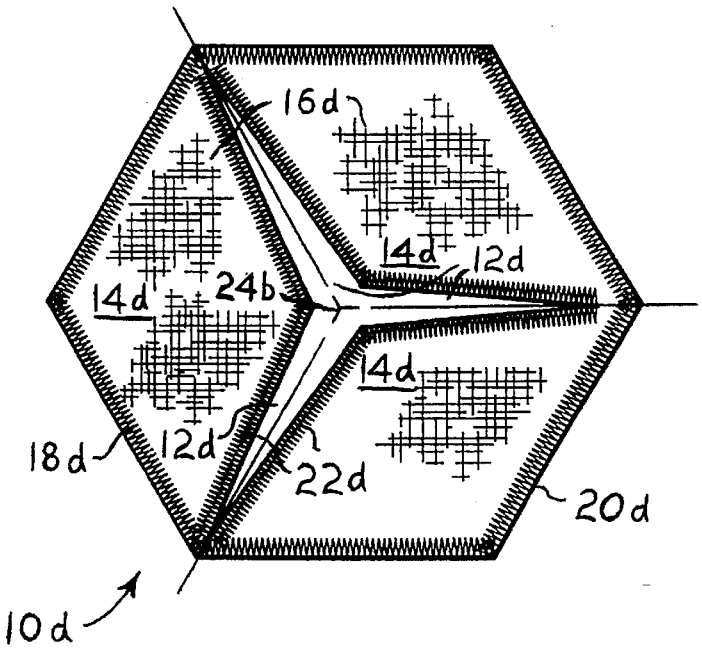
FIG. 6 is a plan view of another alternative configuration, showing three equally spaced slots therein.
Figure 7:
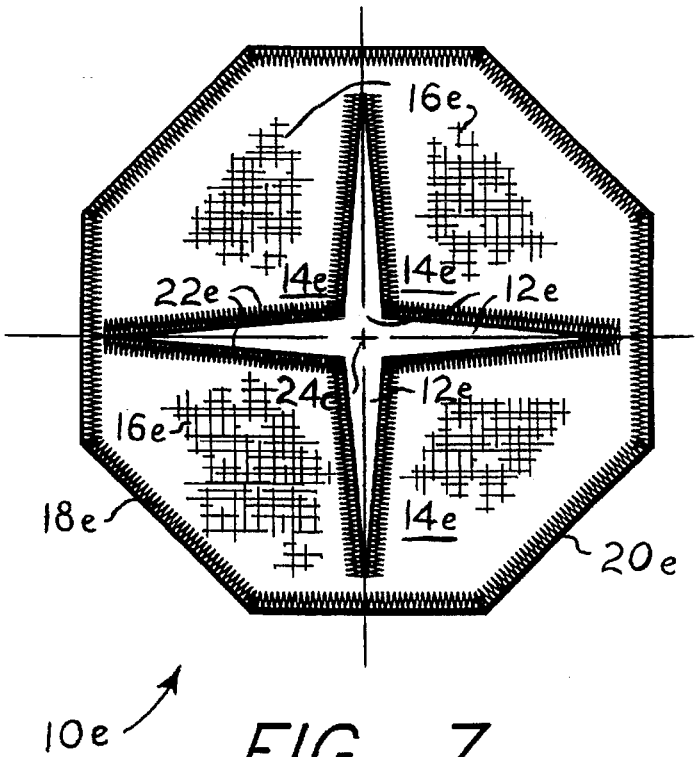
FIG. 7 is a plan view of yet another configuration, showing a different peripheral shape.

FIGS. 6 and 7 disclose still further configurations of the present headgear accessory, respectively described as accessories 10*d* and 10*e*. These accessories 10*d* and 10*e* are basically similarly configured to the headgear accessories 10*a* through 10*c* discussed above, in that they are formed of a flat, flexible sheet of material having a plurality of slots 12*d*/12*e* extending radially from a center point 24*b*/24*c*. The slots 24*b*/24*c* serve to divide the area of the respective headgear accessories 10*d*/10*e* into a plurality of equal flaps or segments 14*d*/14*e*, which segments each include a fabric overlay 16*d*/16*e*. Stitching or embroidery 18*d*/18*e* may be provided about the respective peripheries 20*d*/20*e* of the respective accessories 10*d*/10*e*, and further stitching 22*d*/22*e* along the edges of the flaps or segments 14*d*/14*e*, similarly to the earlier discussed embodiments. However, the embodiment 10*d* of FIG. 6 will be seen to have a hexagonal configuration, with only three slots 12*d* dividing a corresponding three segments 14*d*. Other numbers of slots and segments may be provided as desired. The embodiment 10*e* of FIG. 7 will be seen to be similar to the embodiments 10 through 10*c*, in that four slots 12*e* divide the sheet into four equally sized segments 14e in a cruciform configuration. Only the shape of the periphery is different, with the periphery 20*e* of the embodiment 10*e* of FIG. 7 having an octagonal shape. Again, other peripheral shapes may be used as desired, with differing numbers of slots and corresponding numbers of segments or flaps provided, as desired.

In summary, the present headgear accessory in its various embodiments, will be seen to provide a neat, orderly, and attractive means of allowing the hairdo of a person having relatively long hair, to flow from a hat, cap, or other headgear without being trapped beneath the headgear or within an outer garment. By providing the selected hat, cap, hood, etc. with a suitable hole or opening in the upper rear portion thereof, the present headgear accessory may be secured (sewn, glued, etc.) thereover, to conceal the relatively unsightly hole in the headgear. While only one hole and a corresponding one headgear accessory has been shown in each example, it will be seen that more than one accessory may be installed in any given headgear article, e.g., for plural braids, etc., if desired.

The resilient nature of the preferred neoprene material results in the flaps or segments of the accessory folding to a flat, planar and substantially closed position when not biased open by gathered hair passing therethrough. As the flaps or segments are pushed to a relative outwardly disposition, if the hair is pulled back through the accessory (and headgear to which it is secured), the edges of the flaps or segments will tend to be drawn back toward their normally relaxed and closed disposition, thereby providing some additional gripping of the hair to provide greater security to retain the headgear on the head of the wearer thereof. The peripheral and segment edge stitching provides not only additional structural strength for the present headgear accessory, but also provides decoration in matching or contrasting colors to the fabric overlay material and/or to the headgear to which the accessory is secured. Thus, the present accessory will be seen to provide an attractive solution for a problem which has existed for some time, i.e., the arrangement of longer hair beneath or outside of a hat or other headgear, and in addition the retention of the headgear on the head of the wearer.

It is to be understood that the present invention is not limited to the sole embodiments described above, but encompasses any and all embodiments within the scope of the following claims.

I claim:

1. A headgear accessory adapted for installation to a headgear article having a hole in the upper rear portion thereof for the passage therethrough of the hair of a wearer of the headgear, said headgear accessory comprising:

a generally flat, planar, flexible, and resilient sheet of material having a periphery, a center, and a plurality of slots radiating from said center outwardly across said sheet toward said periphery;

said slots defining a plurality of radially disposed segments in said sheet, with said segments being resiliently distensible to resiliently grip and conform to the hair of a wearer of said headgear accessory as the hair is passed therethrough; and each of said segments having edges adjacent to corresponding said slots, and said edges of said segments include stitching therealong providing additional strength and finish;

whereby said headgear accessory may be passed over the hair of a wearer thereof by means of resiliently distending said segments to open said slots, and said segments may flexibly and resiliently close about the hair passing therebetween to secure said headgear accessory to the hair of a wearer of said headgear accessory.

2. The headgear accessory of claim 1 wherein:

said flexible and resilient sheet of material comprises neoprene.

3. The headgear accessory of claim 2 wherein:

said flexible and resilient sheet of material includes a synthetic fabric overlay providing additional strength and finish.

4. The headgear accessory of claim 1 including:

stitching about said periphery providing additional strength and finish.

5. The headgear accessory of claim 1 wherein:

said periphery is circular.

6. The headgear accessory of claim 1 wherein:

said periphery comprises a regular polygonal shape.

7. The headgear accessory of claim 1 wherein:

said sheet of material is evenly divided by four slots radiating from said center in a cruciform pattern.

8. The headgear accessory of claim 1 wherein:

said sheet of material is evenly divided by three slots radiating from said center.

9. An article of headgear comprising:

a headgear article having an upper rear portion, with said upper rear portion including a hole therethrough adapted for the passage therethrough of the hair of a wearer of said headgear article;

a headgear accessory secured concentrically across said hole through said headgear article, with said headgear accessory comprising a generally flat, planar, flexible, and resilient sheet of material having a periphery, a center, and a plurality of slots radiating from said center outwardly across said sheet toward said periphery;

said slots defining a plurality of radially disposed segments in said sheet, with said segments being resiliently distensible to resiliently grip and conform to the hair of a wearer of said headgear accessory as the hair is passed therethrough; and each of said segments of said headgear accessory having edges adjacent to corresponding said slots, and said edges of said segments include stitching therealong providing additional strength and finish;

whereby said headgear article and said headgear accessory secured thereto may be passed over the hair of a wearer thereof by means of resiliently distending said segments of said headgear accessory to open said slots and passing the hair through said hole in said headgear article and said slots of said headgear accessory, with said segments of said headgear accessory flexibly and resiliently closing about the hair passing therebetween to secure said headgear article to the hair of a wearer of said headgear article.

10. The headgear article of claim 9 wherein:

said flexible and resilient sheet of material of said headgear accessory comprises neoprene.

11. The headgear article of claim 10 wherein:

said flexible and resilient sheet of material includes a synthetic fabric overlay providing additional strength and finish.

12. The headgear article of claim 9 including:

stitching about said periphery of said headgear accessory, providing additional strength and finish.

13. The headgear article of claim 9 wherein:

said periphery of said headgear accessory is circular.

14. The headgear article of claim 9 wherein:

said periphery of said headgear accessory comprises a regular polygonal shape.

15. The headgear article of claim 9 wherein:

said sheet of material of said headgear accessory is evenly divided by four slots radiating from said center in a cruciform pattern.

16. The headgear article of claim 9 wherein:

said sheet of material of said headgear accessory is evenly divided by three slots radiating from said center.

17. The headgear article of claim 9 wherein:

said headgear article is selected from the group consisting of closely fitting visored caps, knit stocking caps, brimless hats, and brimmed hats.

18. The headgear article of claim 9 wherein:

said headgear article is the hood portion of a hooded garment.

* * * * *